US011626081B2

(12) United States Patent
Zhang

(10) Patent No.: US 11,626,081 B2
(45) Date of Patent: Apr. 11, 2023

(54) DISPLAY PANEL AND DRIVING METHOD THEREOF

(71) Applicant: TCL CHINA STAR OPTOELECTRONICS TECHNOLOGY CO., LTD., Guangdong (CN)

(72) Inventor: Xin Zhang, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 310 days.

(21) Appl. No.: 16/972,913

(22) PCT Filed: Oct. 15, 2020

(86) PCT No.: PCT/CN2020/121074
§ 371 (c)(1),
(2) Date: Dec. 7, 2020

(87) PCT Pub. No.: WO2022/047900
PCT Pub. Date: Mar. 10, 2022

(65) Prior Publication Data

US 2022/0319457 A1 Oct. 6, 2022

(30) Foreign Application Priority Data

Sep. 4, 2020 (CN) ..... 202010919121.1

(51) Int. Cl.
*G09G 3/36* (2006.01)

(52) U.S. Cl.
CPC ..... *G09G 3/3614* (2013.01); *G09G 3/3607* (2013.01); *G09G 3/3677* (2013.01); *G09G 3/3688* (2013.01); *G09G 2300/0452* (2013.01)

(58) Field of Classification Search
CPC ... G09G 2300/0426; G09G 2310/0224; G09G 2310/024
See application file for complete search history.

(56) References Cited

U.S. PATENT DOCUMENTS 10,235,921 B2 * 3/2019 Tien ..... G09G 3/2092
10,789,894 B2 * 9/2020 Zheng ..... G09G 3/3266
(Continued)

FOREIGN PATENT DOCUMENTS

CN 101231402 A 7/2008
CN 102236223 A 11/2011
(Continued)

OTHER PUBLICATIONS

CN111474791A Pixel structure, display panel with pixel structure and display device Jul. 31, 2020 Shenzhen (Year: 2020).*

*Primary Examiner* — Van N Chow

(57) ABSTRACT

A display panel and a driving method thereof are provided. The display panel includes a plurality of sub-pixels arranged in an array. The plurality of sub-pixels are divided into a plurality of units arranged along rows and columns, and the unit includes a plurality of the sub-pixels. Polarities of the sub-pixels in any two adjacent sub-units are different, a number of the sub-pixels in any one of the sub-units is less than or equal to 4, and a number of the sub-pixels in one of the sub-units that has a common boundary with the unit is less than or equal to 2.

17 Claims, 2 Drawing Sheets

(56) References Cited

U.S. PATENT DOCUMENTS

| | | | | |
|---|---|---|---|---|
| 2012/0013657 | A1 | 1/2012 | Tang | |
| 2013/0271436 | A1 | 10/2013 | Shiomi | |
| 2016/0299391 | A1 | 10/2016 | Liu et al. | |
| 2019/0189069 | A1* | 6/2019 | Huang | G09G 3/3688 |
| 2020/0184895 | A1* | 6/2020 | Zhao | G02F 1/136286 |
| 2020/0279892 | A1* | 9/2020 | Chen | H01L 27/3218 |

FOREIGN PATENT DOCUMENTS

| | | | |
|---|---|---|---|
| CN | 104820325 | A | 8/2015 |
| CN | 107180606 | A | 9/2017 |
| CN | 109599073 | A | 4/2019 |
| CN | 110910846 | A | 3/2020 |
| CN | 111474791 | A | 7/2020 |

* cited by examiner

DISPLAY PANEL AND DRIVING METHOD THEREOF

FIELD OF DISCLOSURE

The present disclosure relates to the field of display technologies, and in particular to a display panel and a driving method thereof.

BACKGROUND

With a development of display technologies, in large-size and high-resolution liquid crystal display panels such as 8K pixels, a problem of low charging efficiency of the display panel has attracted widespread attention.

SUMMARY OF DISCLOSURE

At present, in order to improve a charging efficiency of large-sized display panels, an HG2D (half gate and two data) structure is adopted in the display panels. That is, sub-pixels arranged in one column correspond to two data lines. In comparison to an existing structure, a charging efficiency is doubled, thereby improving the charging efficiency of the display panel. However, if the HG2D structure is paired with data lines of different polarities, an area formed by sub-pixels of the same polarity arranged together is larger. When the display panel is displayed, it will cause a graininess in a gray-scale image, thereby affecting a display performance.

The present disclosure provides a display panel to solve a technical problem of a large area formed by sub-pixels of the same polarity arranged together in an existing HG2D structure, which causes an image displayed by the display panel to appear grainy.

In order to solve the above problem, technical solutions provided by the present disclosure are as follows.

The present disclosure provides a display panel including the follow.

A plurality of sub-pixels are arranged in an array. The plurality of sub-pixels are divided into a plurality of units arranged along rows and columns, and any one of the units includes a plurality of the sub-pixels arranged in a 4×12 array.

A plurality of scan lines are configured to transmit scan signals to the sub-pixels. The sub-pixels arranged in one row correspond to one of the scan lines.

A plurality of data lines are configured to transmit data signals to the sub-pixels. Two data lines are disposed between the sub-pixels of two adjacent columns, and the sub-pixels arranged in any one column correspond to two data lines with different polarities.

Each of the units includes a plurality of sub-units, polarities of the sub-pixels in each of the sub-units are the same, and polarities of the sub-pixels in any two adjacent sub-units are different, a number of the sub-pixels in any one of the sub-units is less than or equal to 4, and a number of the sub-pixels in one of the sub-units that has a common boundary with the unit is less than or equal to 2.

In the display panel of the present disclosure, each of the plurality of sub-units includes a first sub-unit and a second sub-unit, a number of the sub-pixels in the first sub-unit is 4, and a number of the sub-pixels in the second sub-unit is less than or equal to 2, and the sub-unit that has the common boundary with the unit is the second sub-unit.

A number of first sub-units is greater than or equal to 2, and at least one second sub-unit is disposed between the first sub-units.

In the display panel of the present disclosure, the sub-pixels in a first row in the unit are a first polarity group, the sub-pixels in a second row in the unit are a second polarity group, the sub-pixels in a third row in the unit are a third polarity group, and the sub-pixels in a fourth row in the unit are a fourth polarity group.

The first polarity group and the fourth polarity group have the same polarity, the second polarity group and the third polarity group have the same polarity, and polarities of the first polarity group and the fourth polarity group are opposite to polarities of the second polarity group and the third polarity group.

In the display panel of the present disclosure, the first polarity group and the fourth polarity group are arranged in a form of positive polarity, negative polarity, positive polarity, positive polarity, negative polarity, positive polarity, negative polarity, positive polarity, negative polarity, negative polarity, positive polarity, and negative polarity.

The second polarity group and the third polarity group are arranged in a form of negative polarity, positive polarity, negative polarity, negative polarity, positive polarity, negative polarity, positive polarity, negative polarity, positive polarity, positive polarity, negative polarity, and positive polarity.

A polarity of any one of the sub-pixels in a second frame is opposite to a polarity of which in a first frame.

In the display panel of the present disclosure, the sub-pixel is a red sub-pixel, a green sub-pixel, or a blue sub-pixel.

In the unit, the sub-pixels in each row are repeatedly arranged as the red sub-pixel, the green sub-pixel, and the blue sub-pixel.

In the display panel of the present disclosure, in the unit, the sub-pixels in each column have the same color.

In the display panel of the present disclosure, each of the first sub-units includes only the blue sub-pixel and the red sub-pixel.

In the display panel of the present disclosure, the unit corresponds to 24 data lines, polarities of two of the data lines disposed between the sub-pixels of two adjacent columns are the same, and in the unit, polarities of the data lines are repeatedly arranged in a form of positive polarity, negative polarity, negative polarity, and positive polarity.

In the display panel of the present disclosure, a scan line corresponding to the sub-pixels in a first row in the unit is a first scan line, a scan line corresponding to the sub-pixels in a second row in the unit is a second scan line, a scan line corresponding to the sub-pixels in a third row in the unit is a third scan line, a scan line corresponding to the sub-pixels in a fourth row in the unit is a fourth scan line.

The first scan line is connected in parallel with the second scan line, and the third scan line is connected in parallel with the fourth scan line.

The present disclosure also provides a driving method of a display panel, including:

arranging a plurality of sub-pixels in an array, and defining a plurality of units arranged along rows and columns, where any one of the units includes a plurality of the sub-pixels arranged in a 4×12 array, each of the units includes a plurality of sub-units, polarities of the sub-pixels in each of the sub-units are the same, and polarities of the sub-pixels in any two adjacent sub-units are different, a number of the sub-pixels in any one of the sub-units is less than or equal to 4, and a number of the sub-pixels in one of the sub-units that has a common boundary with the unit is less than or equal to 2;

transmitting a plurality of scan signals to the sub-pixels through a plurality of scan lines, where the sub-pixels arranged in one row correspond to one of the scan lines; and transmitting a plurality of data signals to the sub-pixels through a plurality of data lines, where two data lines are disposed between the sub-pixels of two adjacent columns, and the sub-pixels arranged in any one column correspond to two data lines with different polarities.

Advantages of the present disclosure are as following. In the present disclosure, the unit is divided into the plurality of sub-units, polarities of the sub-pixels in each of the sub-units are the same, and polarities of the sub-pixels in any two adjacent sub-units are different. A number of the sub-pixels in any one of the sub-units is less than or equal to 4, and a number of the sub-pixels in one of the sub-units that has a common boundary with the unit is less than or equal to 2 such that a number of the sub-pixels of the same polarity arranged together is less than or equal to 4. It is avoided that due to a fact that there are many sub-pixels of the same polarity arranged together during display, an area of the sub-pixels of the same polarity is too large, resulting in a graininess in a display image, thereby improving the display quality.

BRIEF DESCRIPTION OF DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION

Figure 1:
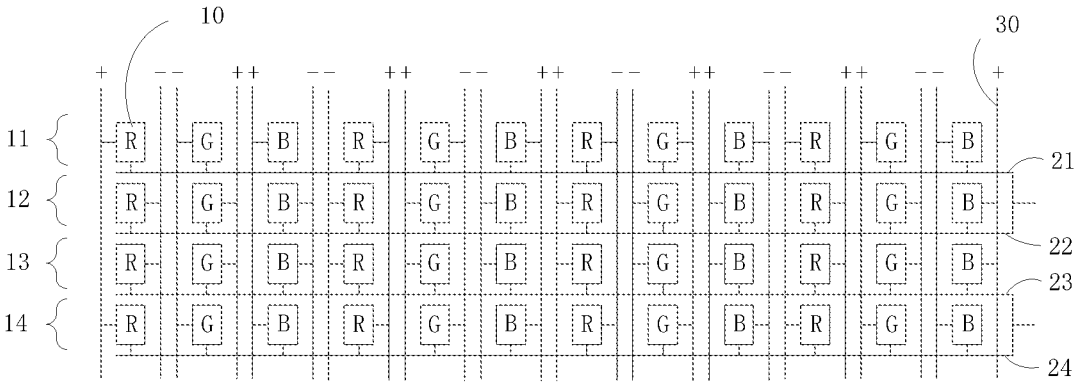
FIG. 1 is a schematic diagram of an arrangement of sub-pixels in a display panel of an embodiment of the present disclosure.

The following embodiments are exemplified by referring to the accompanying drawings, for describing specific embodiments implemented by the present disclosure. Furthermore, directional terms described by the present disclosure, such as upper, lower, front, back, left, right, inner, outer, side and etc., are only directions by referring to the accompanying drawings, and thus the used directional terms are used to describe and understand the present disclosure, but the present disclosure is not limited thereto. In the drawings, like reference numerals indicate like components or items.

In the description of the present disclosure, it is should be understood that positions or position relationships indicated by the terms such as "center," "longitudinal," "transverse," "length," "width," "thickness," "above," "under," "front," "back," "left," "right," "vertical," "horizontal," "top," "bottom" "in," "out," "clockwise," "anticlockwise," etc. are based on the positions or position relationships shown in the drawings. The use of these terms is merely in interest of illustrating the present disclosure and simplifying the description rather than indicating or implying that the referred device or element must have a particular orientation or be constructed and operated in a specific orientation. Therefore, it should not be understood as limits to the present disclosure. In addition, the terms "first" and "second" are merely used for description purposes which cannot to be construed as indicating or implying relative importance or implicitly indicating the number of indicated technical features. Thus, features limited with "first," "second" may explicitly or implicitly include one or more of the features. In the description of the present disclosure, the phrase "a plurality of" refers to two or more items unless it is clearly and specifically defined in other ways.

In the present disclosure, unless there are additional specific rules or limitations, the terms "mount," "connect," "fix," etc. shall be understood in a general sense. For example, it may be a fixed connection, a detachable connection, or an integral connection, also, it may be a mechanical connection, an electrical connection, a direct connection, an indirect connection through some intermediate element, or an internal communication between two elements. Those of ordinary skill in the art can understand the specific meanings of the above-mentioned terms in the present disclosure according to specific circumstances.

In the present disclosure, unless there are additional specific rules or limitations, the first feature is "above" or "under" the second feature may include the conditions where the first feature directly contacts the second feature, and the first feature indirectly contacts the second feature and is connected to the second feature through other features between them. Moreover, the first feature is "above," "over," or "on" the second feature includes the conditions where the first feature is right above and diagonally above the second feature, or the horizontal height of the first feature is higher than that of the second feature. The first feature is "below," "under," and "beneath" the second feature includes the conditions where the first feature is right under and below the second feature, or the horizontal height of the first feature is lower than that of the second feature.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

The technical solutions of the present disclosure will now be described in conjunction with specific embodiments.

Figure 2:
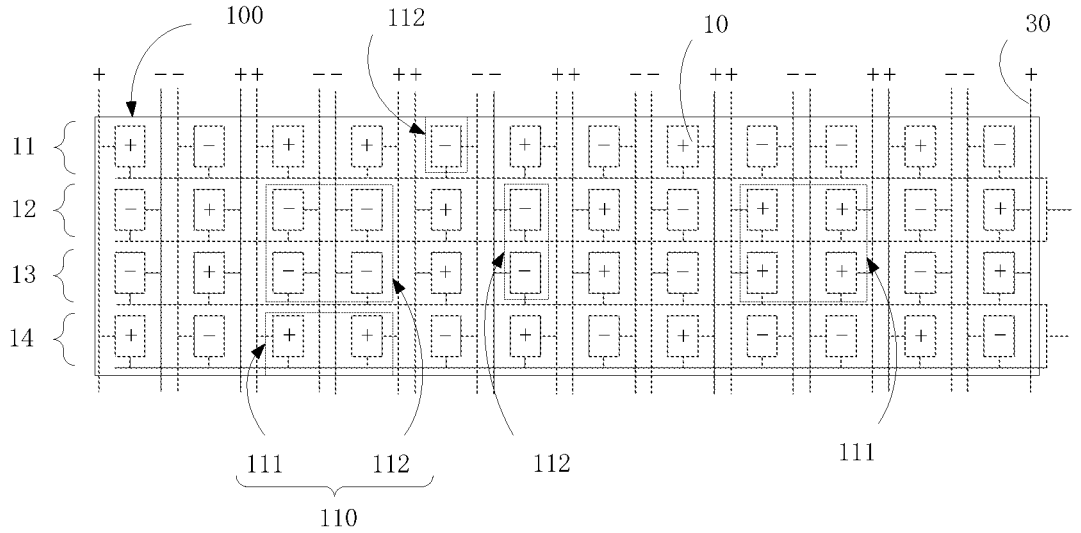
FIG. 2 is a schematic diagram of gray scales and polarities of FIG. 1 in a first frame.
Figure 3:
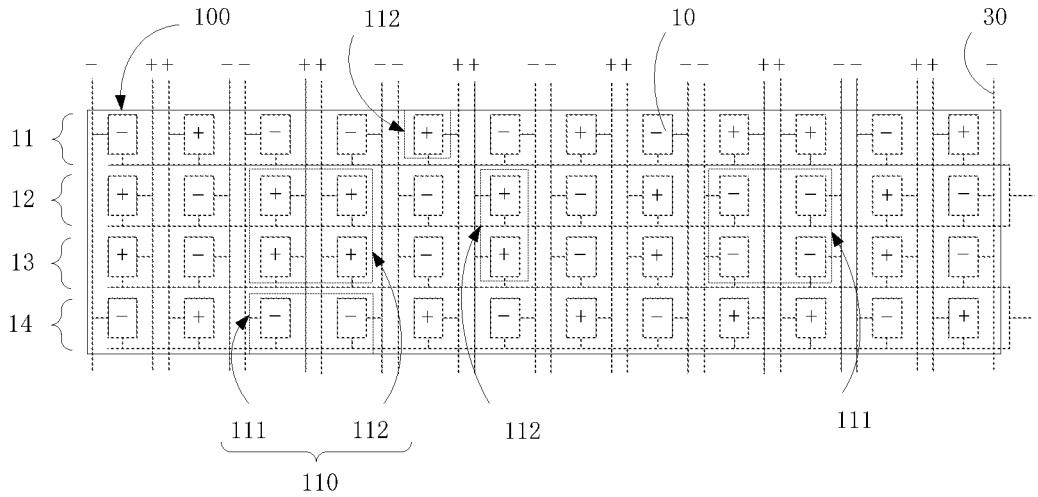
FIG. 3 is a schematic diagram of gray scales and polarities of FIG. 1 in a second frame.

The present disclosure provides a display panel, as shown in FIG. 1 to FIG. 3, including the following.

A plurality of sub-pixels 10 are arranged in an array. The plurality of sub-pixels 10 are divided into a plurality of units 100 arranged along rows and columns, and any one of the units 100 includes a plurality of the sub-pixels 10 arranged in a 4×12 array.

A plurality of scan lines are configured to transmit scan signals to the sub-pixels 10. The sub-pixels 10 arranged in one row correspond to one of the scan lines.

A plurality of data lines 30 are configured to transmit data signals to the sub-pixels 10. Two data lines 30 are disposed between the sub-pixels 10 of two adjacent columns, and the sub-pixels 10 arranged in any one column correspond to two data lines 30 with different polarities.

Each of the units 100 includes a plurality of sub-units 110, polarities of the sub-pixels 10 in each of the sub-units 110 are the same, and polarities of the sub-pixels 10 in any two adjacent sub-units 110 are different, a number of the sub-pixels 10 in any one of the sub-units 110 is less than or equal to 4, and a number of the sub-pixels 10 in one of the sub-units 110 that has a common boundary with the unit 100 is less than or equal to 2.

In should be understood that, at present, in order to improve a charging efficiency of large-sized display panels, an HG2D (half gate and two data) structure is adopted in the display panels. That is, sub-pixels arranged in one column correspond to two data lines. In comparison to an existing structure, a charging efficiency is doubled, thereby improving the charging efficiency of the display panel. However, if the HG2D structure is paired with data lines of different polarities, an area formed by sub-pixels of the same polarity arranged together is larger. When the display panel is displayed, it will cause a graininess in a gray-scale image, thereby affecting a display performance. In this embodiment, the unit 100 is divided into the plurality of sub-units 110, polarities of the sub-pixels 10 in each of the sub-units 110 are the same, and polarities of the sub-pixels 10 in any two adjacent sub-units 110 are different. A number of the sub-pixels 10 in any one of the sub-units 110 is less than or equal to 4, and a number of the sub-pixels 10 in one of the sub-units 110 that has a common boundary with the unit 100 is less than or equal to 2 such that a number of the sub-pixels 10 of the same polarity arranged together is less than or equal to 4. It is avoided that due to a fact that there are many sub-pixels of the same polarity arranged together during display, an area of the sub-pixels 10 of the same polarity is too large, resulting in a graininess in a display image, thereby improving the display quality.

It should be noted that the number of sub-pixels 10 in the sub-unit 110 that has a common boundary with the unit 100 is less than or equal to 2. That is, the number of sub-pixels 10 in the sub-unit 110 arranged close to the boundary of the unit 100 is less than or equal to 2. It avoids a situation that the number of sub-pixels 10 of the same polarity arranged together is greater than 4 at the boundary between the two units 100 after the two sub-units 110 in the two unit 100 are connected, so as to avoid the problem of graininess in a displayed image of the display panel. Furthermore, during a display process of the display panel, the sub-pixels 10 in each of the sub-units 110 display the same gray scale, and gray scales displayed by the sub-pixels 10 in any two adjacent sub-units 110 are different. The number of sub-pixels 10 in any one of the sub-units 110 is less than or equal to 4, and the number of sub-pixels 10 in the sub-unit 110 that has the common boundary with the unit 100 is less than or equal to 2. In one embodiment, the sub-pixels 10 set to the positive polarity can be displayed in a low gray scale, and the sub-pixels 10 set to the negative polarity can be displayed in a high gray scale.

In an embodiment, as shown in FIGS. 2 to 3, each of the plurality of sub-units 110 includes a first sub-unit 111 and a second sub-unit 112. A number of the sub-pixels 10 in the first sub-unit 111 is 4. A number of sub-pixels 10 in the second sub-unit 112 is less than or equal to 2. The sub-unit 110 that has the common boundary with the unit 100 is the second sub-unit 112.

A number of first sub-units 111 is greater than or equal to 2, and at least one second sub-unit 112 is disposed between the first sub-units 111.

It can be understood that if there are two or more first sub-units 111, in this embodiment, at least one second sub-unit 112 is disposed between the first sub-units 111. It is avoided that the first sub-units 111 with a larger area are arranged together, that is, the first sub-units 111 are dispersedly arranged, so that the displayed image is more uniform.

In an embodiment, as shown in FIG. 2, the sub-pixels 11 arranged in a first row in the unit 100 are set as a first polarity group. The sub-pixels 12 arranged in a second row in the unit 100 are set as a second polarity group. The sub-pixels 13 arranged in a third row in the unit 100 are set as a third polarity group. The sub-pixels 14 arranged in a fourth row in the unit 100 are set as a fourth polarity group.

The first polarity group and the fourth polarity group have the same polarity. The second polarity group and the third polarity group have the same polarity. The polarities of the first polarity group and the fourth polarity group are opposite to the polarities of the second polarity group and the third polarity group.

It is understandable that this arrangement can avoid an occurrence of the same polarity arrangement of the sub-pixels 10 in three consecutive rows, so that the first sub-unit 111 must be defined in the sub-pixels 12 of the second row and the sub-pixels 13 of the third row. That is, the first sub-unit 111 is disposed in a middle of the unit 100. Similarly, it avoids a situation that the polarity arrangement of the sub-pixels 10 in three consecutive columns are the same after the two units 100 are combined in a column direction, which will not be repeated here.

As shown in FIG. 2, specifically, the first polarity group and the fourth polarity group are repeatedly arranged in a form of positive polarity, negative polarity, positive polarity, positive polarity, negative polarity, positive polarity, negative polarity, positive polarity, negative polarity, negative polarity, positive polarity, and negative polarity.

The second polarity group and the third polarity group are repeatedly arranged in a form of negative polarity, positive polarity, negative polarity, negative polarity, positive polarity, negative polarity, positive polarity, negative polarity, positive polarity, positive polarity, negative polarity, and positive polarity.

A polarity of any one of the sub-pixels in a second frame is opposite to a polarity of which in a first frame.

It can be understood that the unit 100 just includes two first sub-units 111, and there are four second sub-units 112 between the two first sub-units 111. In a case that no two first sub-unit 111 are disposed at the boundary of the unit 100, a distance between the two first sub-units 111 is maximized, thereby avoiding the two first sub-units 111 being arranged together to affect the display performance of the display panel.

In one embodiment, as shown in FIG. 1, the sub-pixel 10 is a red sub-pixel R, a green sub-pixel G, or a blue sub-pixel B. Apparently, the colors of the sub-pixels 10 can be arranged in different forms, which is not limited here.

In the unit 100, the sub-pixels 10 in each row are repeatedly arranged with the red sub-pixel R, the green sub-pixel G, and the blue sub-pixel B. It is understandable that there are exactly 12 sub-pixels 10 in each row. The sub-pixels 10 in each row are repeatedly arranged four times with the red sub-pixel R, the green sub-pixel G, and the blue sub-pixel B. In this embodiment, in the display panel of the present disclosure, each of the first sub-unit 111 includes only the blue sub-pixel B and the red sub-pixel R. Specifically, on the sub-pixels 12 of the second row and the sub-pixels 13 of the third row, both of the first sub-units 111 include two blue sub-pixels B and two red sub-pixels R with darker brightness. The first sub-unit 111 with a larger area has a small grid pattern when displayed. In the unit 100, the colors of the sub-pixels 10 in each column is the same.

In one embodiment, as shown in FIGS. 1 to 3, the unit 100 corresponds to 24 data lines 30, and polarities of two of the data lines 30 between the sub-pixels 10 in any two adjacent columns are the same. In the unit 100, polarities of the data lines 30 are repeatedly arranged in a form of positive polarity, negative polarity, negative polarity, and positive polarity. Moreover, the sub-pixels 10 in any column correspond to two data lines 30 with different polarities to provide different brightness signals and polarity control signals.

In an embodiment, as shown in FIG. 1, a scan line corresponding to the sub-pixels 11 of the first row in the unit 100 is a first scan line 21. A scan line corresponding to the sub-pixels 12 of the second row in the unit 100 is a second scan line 22. A scan line corresponding to the sub-pixels 13 of the third row in the unit 100 is a third scan line 23. A scan line corresponding to the sub-pixels 14 of the fourth row in the unit 100 is a fourth scan line 24.

The first scan line 21 is connected in parallel with the second scan line 22, and the third scan line 23 is connected in parallel with the fourth scan line 24.

It is understandable that the sub-pixels 11 in the first row and the sub-pixels 12 in the second row in the unit 100 are controlled by the same scan signal, and the sub-pixels 13 in the third row and the sub-pixels 14 in the fourth row in the unit 100 are controlled by the other same scan signal. In this embodiment, the sub-pixels 10 in two rows are simultaneously turned on through one scan signal, which reduces a charging time of the sub-pixels 10 and speeds up a refresh rate.

Figure 4:
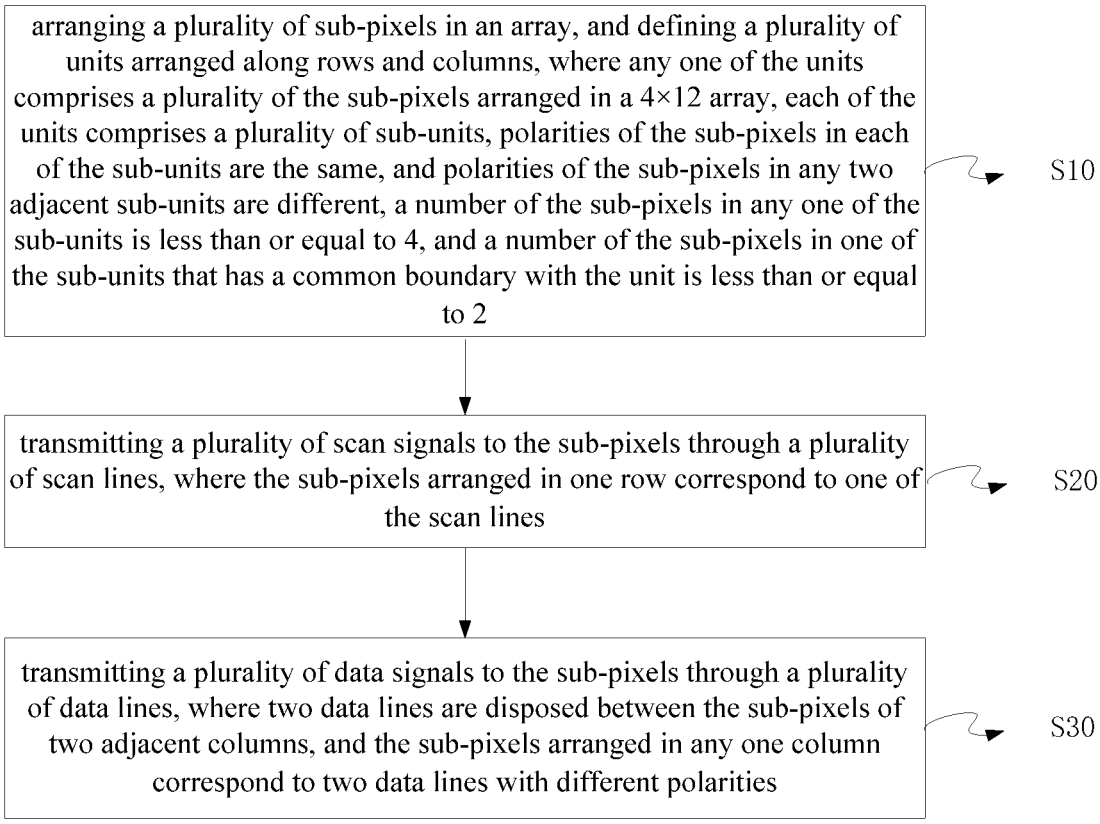
FIG. 4 is a flowchart of a driving method of a display panel of an embodiment of the present disclosure.

The present disclosure also provides a driving method of a display panel, as shown in FIG. 4, including the following.

In as step S10, a plurality of sub-pixels 10 are arranged in an array, and a plurality of units 100 arranged along rows and columns are defined. Any one of the units 100 includes a plurality of the sub-pixels 10 arranged in a 4×12 array, each of the units 100 includes a plurality of sub-units 110, polarities of the sub-pixels 10 in each of the sub-units 110 are the same, and polarities of the sub-pixels 10 in any two adjacent sub-units 110 are different, a number of the sub-pixels 10 in any one of the sub-units 110 is less than or equal to 4, and a number of the sub-pixels 10 in one of the sub-units 110 that has a common boundary with the unit 100 is less than or equal to 2.

In as step S20, a plurality of scan signals transmits to the sub-pixels 10 through a plurality of scan lines. The sub-pixels 10 arranged in one row correspond to one of the scan lines.

In as step S30, a plurality of data signals transmits to the sub-pixels through a plurality of data lines. Two data lines 30 are disposed between the sub-pixels 10 of two adjacent columns, and the sub-pixels 10 arranged in any one column correspond to two data lines 30 with different polarities.

In summary, in the present disclosure, the unit 100 is divided into the plurality of sub-units 110, polarities of the sub-pixels 10 in each of the sub-units 110 are the same, and polarities of the sub-pixels 10 in any two adjacent sub-units 110 are different. A number of the sub-pixels 10 in any one of the sub-units 110 is less than or equal to 4, and a number of the sub-pixels 10 in one of the sub-units 110 that has a common boundary with the unit 100 is less than or equal to 2 such that a number of the sub-pixels 10 of the same polarity arranged together is less than or equal to 4. It is avoided that due to a fact that there are many sub-pixels of the same polarity arranged together during display, an area of the sub-pixels 10 of the same polarity is too large, resulting in a graininess in a display image, thereby improving the display quality.

The above descriptions are merely preferable embodiments of the present disclosure, but are not intended to limit the scope of the present disclosure. Any modifications or replacements made by those skilled in the art without departing from the spirit and principle of the present disclosure should fall within the protection scope of the present disclosure. Therefore, the protection scope of the present disclosure is subject to the appended claims.

What is claimed is:

1. A display panel, comprising:

a plurality of sub-pixels arranged in an array, wherein the plurality of sub-pixels are divided into a plurality of units arranged along rows and columns, and any one of the units comprises a plurality of the sub-pixels arranged in a 4×12 array;

a plurality of scan lines configured to transmit scan signals to the sub-pixels, wherein the sub-pixels arranged in one row correspond to one of the scan lines; and a plurality of data lines configured to transmit data signals to the sub-pixels, wherein two data lines are disposed between the sub-pixels of two adjacent columns, and the sub-pixels arranged in any one column correspond to two data lines with different polarities, wherein each of the units comprises a plurality of sub-units, polarities of the sub-pixels in each of the sub-units are the same, and polarities of the sub-pixels in any two adjacent sub-units are different, a number of the sub-pixels in any one of the sub-units is less than or equal to 4, and a number of the sub-pixels in one of the sub-units that has a common boundary with the unit is less than or equal to 2.

2. The display panel as claimed in claim 1, wherein each of the plurality of sub-units comprises a first sub-unit and a second sub-unit, a number of the sub-pixels in the first sub-unit is 4, and a number of the sub-pixels in the second sub-unit is less than or equal to 2, and the sub-unit that has the common boundary with the unit is the second sub-unit; and a number of first sub-units is greater than or equal to 2, and at least one second sub-unit is disposed between the first sub-units.

3. The display panel as claimed in claim 2, wherein the sub-pixels in a first row in the unit are a first polarity group, the sub-pixels in a second row in the unit are a second polarity group, the sub-pixels in a third row in the unit are a third polarity group, and the sub-pixels in a fourth row in the unit are a fourth polarity group; and the first polarity group and the fourth polarity group have the same polarity, the second polarity group and the third polarity group have the same polarity, and polarities of the first polarity group and the fourth polarity group are opposite to polarities of the second polarity group and the third polarity group.

4. The display panel as claimed in claim 3, wherein the first polarity group and the fourth polarity group are arranged in a form of positive polarity, negative polarity, positive polarity, positive polarity, negative polarity, positive polarity, negative polarity, positive polarity, negative polarity, negative polarity, positive polarity, and negative polarity;

the second polarity group and the third polarity group are arranged in a form of negative polarity, positive polarity, negative polarity, negative polarity, positive polarity, negative polarity, positive polarity, negative polarity, positive polarity, positive polarity, negative polarity, and positive polarity; and a polarity of any one of the sub-pixels in a second frame is opposite to a polarity of which in a first frame.

5. The display panel as claimed in claim 2, wherein the sub-pixel is a red sub-pixel, a green sub-pixel, or a blue sub-pixel; and in the unit, the sub-pixels in each row are repeatedly arranged as the red sub-pixel, the green sub-pixel, and the blue sub-pixel.

6. The display panel as claimed in claim 5, wherein in the unit, the sub-pixels in each column have the same color.

7. The display panel as claimed in claim 5, wherein each of the first sub-units includes only the blue sub-pixel and the red sub-pixel.

8. The display panel as claimed in claim 1, wherein the unit corresponds to 24 data lines, polarities of two of the data lines disposed between the sub-pixels of two adjacent columns are the same, and in the unit, polarities of the data lines are repeatedly arranged in a form of positive polarity, negative polarity, negative polarity, and positive polarity.

9. The display panel as claimed in claim 1, wherein a scan line corresponding to the sub-pixels in a first row in the unit is a first scan line, a scan line corresponding to the sub-pixels in a second row in the unit is a second scan line, a scan line corresponding to the sub-pixels in a third row in the unit is a third scan line, a scan line corresponding to the sub-pixels in a fourth row in the unit is a fourth scan line; and the first scan line is connected in parallel with the second scan line, and the third scan line is connected in parallel with the fourth scan line.

10. A display panel, comprising:

a plurality of sub-pixels arranged in an array, wherein the plurality of sub-pixels are divided into a plurality of units arranged along rows and columns, and any one of the units comprises a plurality of the sub-pixels arranged in a 4×12 array;

a plurality of scan lines configured to transmit scan signals to the sub-pixels, wherein the sub-pixels arranged in one row correspond to one of the scan lines; and a plurality of data lines configured to transmit data signals to the sub-pixels, wherein two data lines are disposed between the sub-pixels of two adjacent columns, and the sub-pixels arranged in any one column correspond to two data lines with different polarities, wherein each of the units comprises a plurality of sub-units, polarities of the sub-pixels in each of the sub-units are the same, and polarities of the sub-pixels in any two adjacent sub-units are different, a number of the sub-pixels in any one of the sub-units is less than or equal to 4, and a number of the sub-pixels in one of the sub-units that has a common boundary with the unit is less than or equal to 2;

each of the plurality of sub-units comprises a first sub-unit and a second sub-unit, a number of the sub-pixels in the first sub-unit is 4, and a number of the sub-pixels in the second sub-unit is less than or equal to 2, and the sub-unit that has the common boundary with the unit is the second sub-unit;

a number of first sub-units is greater than or equal to 2, and at least one second sub-unit is disposed between the first sub-units; and the unit corresponds to 24 data lines, polarities of two of the data lines disposed between the sub-pixels of two adjacent columns are the same, and in the unit, polarities of the data lines are repeatedly arranged in a form of positive polarity, negative polarity, negative polarity, and positive polarity.

11. The display panel as claimed in claim 10, wherein the sub-pixels in a first row in the unit are a first polarity group, the sub-pixels in a second row in the unit are a second polarity group, the sub-pixels in a third row in the unit are a third polarity group, and the sub-pixels in a fourth row in the unit are a fourth polarity group; and the first polarity group and the fourth polarity group have the same polarity, the second polarity group and the third polarity group have the same polarity, and polarities of the first polarity group and the fourth polarity group are opposite to polarities of the second polarity group and the third polarity group.

12. The display panel as claimed in claim 11, wherein the first polarity group and the fourth polarity group are arranged in a form of positive polarity, negative polarity, positive polarity, positive polarity, negative polarity, positive polarity, negative polarity, positive polarity, negative polarity, negative polarity, positive polarity, and negative polarity;

the second polarity group and the third polarity group are arranged in a form of negative polarity, positive polarity, negative polarity, negative polarity, positive polarity, negative polarity, positive polarity, negative polarity, positive polarity, positive polarity, negative polarity, and positive polarity; and a polarity of any one of the sub-pixels in a second frame is opposite to a polarity of which in a first frame.

13. The display panel as claimed in claim 10, wherein the sub-pixel is a red sub-pixel, a green sub-pixel, or a blue sub-pixel; and in the unit, the sub-pixels in each row are repeatedly arranged as the red sub-pixel, the green sub-pixel, and the blue sub-pixel.

14. The display panel as claimed in claim 13, wherein in the unit, the sub-pixels in each column have the same color.

15. The display panel as claimed in claim 13, wherein each of the first sub-units includes only the blue sub-pixel and the red sub-pixel.

16. The display panel as claimed in claim 10, wherein a scan line corresponding to the sub-pixels in a first row in the unit is a first scan line, a scan line corresponding to the sub-pixels in a second row in the unit is a second scan line, a scan line corresponding to the sub-pixels in a third row in the unit is a third scan line, a scan line corresponding to the sub-pixels in a fourth row in the unit is a fourth scan line; and the first scan line is connected in parallel with the second scan line, and the third scan line is connected in parallel with the fourth scan line.

17. A driving method of a display panel, comprising:

arranging a plurality of sub-pixels in an array, and defining a plurality of units arranged along rows and columns, wherein any one of the units comprises a plurality of the sub-pixels arranged in a 4×12 array, each of the units comprises a plurality of sub-units, polarities of the sub-pixels in each of the sub-units are the same, and polarities of the sub-pixels in any two adjacent sub-units are different, a number of the sub-pixels in any one of the sub-units is less than or equal to 4, and a number of the sub-pixels in one of the sub-units that has a common boundary with the unit is less than or equal to 2;

transmitting a plurality of scan signals to the sub-pixels through a plurality of scan lines, wherein the sub-pixels arranged in one row correspond to one of the scan lines; and transmitting a plurality of data signals to the sub-pixels through a plurality of data lines, wherein two data lines are disposed between the sub-pixels of two adjacent columns, and the sub-pixels arranged in any one column correspond to two data lines with different polarities.

* * * * *